US009980039B2

(12) United States Patent
Akino

(10) Patent No.: US 9,980,039 B2
(45) Date of Patent: May 22, 2018

(54) UNIDIRECTIONAL MICROPHONE

(71) Applicant: KABUSHIKI KAISHA AUDIO-TECHNICA, Machida-shi, Tokyo (JP)

(72) Inventor: Hiroshi Akino, Machida (JP)

(73) Assignee: KABUSHIKI KAISHA AUDIO-TECHNICA, Machida-Shi, Toyo (JP)

( * ) Notice: Subject to any disclaimer, the term of this patent is extended or adjusted under 35 U.S.C. 154(b) by 0 days. days.

(21) Appl. No.: 15/388,488

(22) Filed: Dec. 22, 2016

(65) Prior Publication Data

US 2017/0195782 A1 Jul. 6, 2017

(30) Foreign Application Priority Data

Jan. 6, 2016 (JP) ..... 2016-000997

(51) Int. Cl.

| | |
|---|---|
| ***H04R 9/08*** | (2006.01) |
| ***H04R 11/04*** | (2006.01) |
| ***H04R 17/02*** | (2006.01) |
| ***H04R 19/04*** | (2006.01) |
| ***H04R 21/02*** | (2006.01) |
| ***H04R 1/32*** | (2006.01) |
| ***H04R 23/02*** | (2006.01) |
| ***H04R 3/00*** | (2006.01) |

(52) U.S. Cl.

CPC ..... *H04R 1/326* (2013.01); *H04R 3/005* (2013.01); *H04R 23/02* (2013.01); *H04R 2430/25* (2013.01)

(58) Field of Classification Search

CPC ..... H04R 1/326; H04R 3/005; H04R 23/02; H04R 2430/25

USPC ..... 381/356

See application file for complete search history.

(56) References Cited

U.S. PATENT DOCUMENTS

| | | | | |
|---|---|---|---|---|
| 2002/0110256 | A1* | 8/2002 | Watson | B60R 1/12 381/389 |
| 2008/0212814 | A1* | 9/2008 | Barthel | H04R 3/005 381/313 |
| 2009/0323977 | A1* | 12/2009 | Kobayashi | H04R 1/406 381/71.8 |
| 2016/0080867 | A1* | 3/2016 | Nugent | H04R 1/026 381/26 |
| 2016/0234591 | A1* | 8/2016 | Sanger | H04R 1/2884 |

FOREIGN PATENT DOCUMENTS

JP 2015-111812 A 6/2014

* cited by examiner

*Primary Examiner* — Sean H Nguyen
(74) *Attorney, Agent, or Firm* — Manabu Kanesaka

(57) ABSTRACT

To obtain a unidirectional microphone with high sound quality, which achieves unidirectivity while preventing deterioration in sound quality of a ribbon microphone. A unidirectional condenser microphone and bi-directional ribbon microphones are included, and the unidirectional condenser microphone and the bi-directional ribbon microphones are disposed such that a 0° direction of a sound collecting axis of the unidirectional condenser microphone accords with a 180° direction of sound collecting axes of the bi-directional ribbon microphones, and an output of the unidirectional condenser microphone is subtracted from an output of the 180° direction of the bi-directional ribbon microphones.

4 Claims, 7 Drawing Sheets

UNIDIRECTIONAL MICROPHONE

RELATED APPLICATIONS

The present application is based on, and claims priority from, Japanese Application No. JP2016-000997 filed Jan. 6, 2016, the disclosure of which is hereby incorporated by reference herein in its entirety.

BACKGROUND OF THE INVENTION

Field of the Invention

The present invention relates to a unidirectional microphone, and more particularly relates to a unidirectional microphone that can realize unidirectivity while preventing deterioration in sound quality.

Description of the Related Art

Bi-directional ribbon microphones have been considered to have good sound quality, and enable obtainment of a favorable directional frequency response in a frequency band from a low resonant frequency and higher because the microphone is mass controlled.

However, use of a long damping acoustic tube is needed for realization of unidirectivity or non-directivity. Further, since the damping acoustic tube has a finite length, obtainment of the favorable directional frequency response is difficult.

Meanwhile, unidirectional condenser microphones can enable the favorable directional frequency response even with small size.

Therefore, realization of the bi-directional ribbon microphones having unidirectivity with good sound quality has been desired. Further, realization of the unidirectivity can suppress occurrence of howling at a time of amplification.

Conventionally, it is known that the unidirectivity is obtained by summing an output of a bi-directional ribbon microphone element and an output of a non-directional condenser microphone element.

That is, when the output of the bi-directional ribbon microphone element illustrated in the graph of directional frequency characteristics of FIG. 6A and the output of the non-directional condenser microphone element of the graph of directional frequency characteristics of FIG. 6B are added, then, unidirectional characteristics with a large output in a 0° direction is obtained, as illustrated in FIG. 6C.

In Japanese Unexamined Patent Application No. 2015-111812 A, the applicant of the present application discloses a stereo microphone including one non-directional condenser microphone unit and two bi-directional ribbon microphone units. In the stereo microphone, directional axes of the two bi-directional ribbon microphone units are arranged to form a predetermined angle with respect to a central axis of a directional axis of the stereo microphone in the same plane, and an acoustic terminal of the non-directional condenser microphone unit is arranged close to acoustic terminals of the bi-directional ribbon microphone units.

According to this configuration, the stereo microphone can provide excellent directional frequency characteristics.

However, in a case of the configuration where the output of the bi-directional ribbon microphone element and the output of the non-directional condenser microphone element are added to obtain the unidirectivity, a problem that the sound quality is deteriorated by adding arises, because half of the output illustrated in FIG. 6C is an audio signal from the non-directional condenser microphone.

SUMMARY OF THE INVENTION

The present invention has been made in view of the foregoing, and an objective is to provide a unidirectional microphone with high sound quality, which can realize unidirectivity while preventing deterioration in the sound quality of a ribbon microphone.

In order to solve the above problem, a unidirectional microphone according to the present invention includes: a unidirectional condenser microphone; and a bi-directional ribbon microphone, wherein the unidirectional condenser microphone and the bi-directional ribbon microphone are arranged such that a 0° direction of a sound collecting axis of the unidirectional condenser microphone accords with a 180° direction of a sound collecting axis of the bi-directional ribbon microphone, and an output of the unidirectional condenser microphone is subtracted from an output of the 180° direction of the bi-directional ribbon microphone.

Note that it is desirable to include two bi-directional ribbon microphones, and the two bi-directional ribbon microphones are preferably disposed laterally symmetric to the one condenser microphone.

With such a configuration, the output of the unidirectional condenser microphone from the outputs in the 180° direction of the sound collecting axes of the bi-directional ribbon microphones is subtracted, and thus the unidirectivity can be achieved without impairing the sound quality of the ribbon microphones. Further, use of the unidirectional microphone for amplification can prevent howling.

DESCRIPTION OF THE PREFERRED EMBODIMENTS

Figure 1:
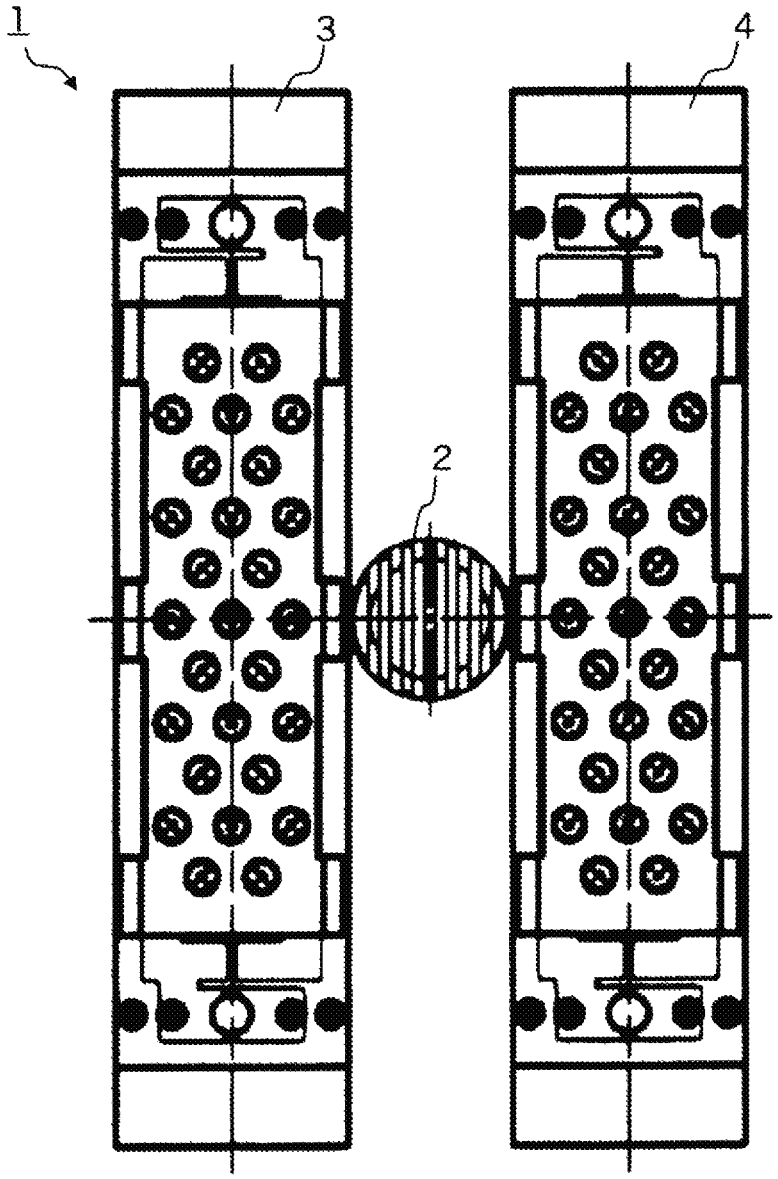
FIG. 1 is a front view (a view as viewed from a 180° side of a sound collecting axis) of a unidirectional microphone according to the present invention.
Figure 2:
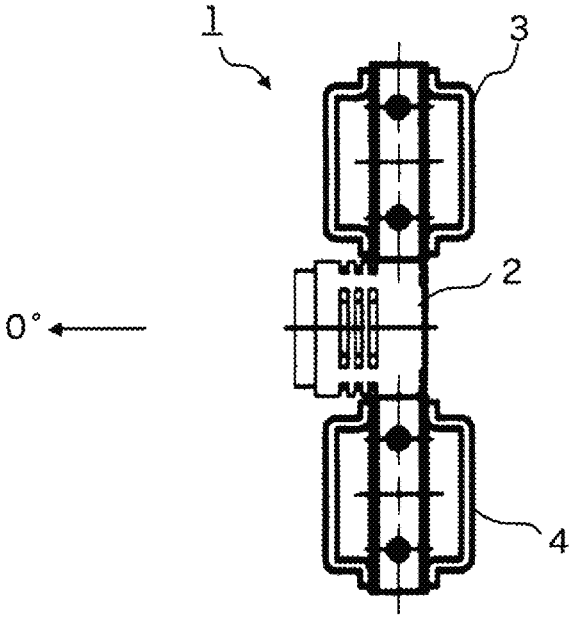
FIG. 2 is a plan view of the unidirectional microphone of FIG. 1.
Figure 3:
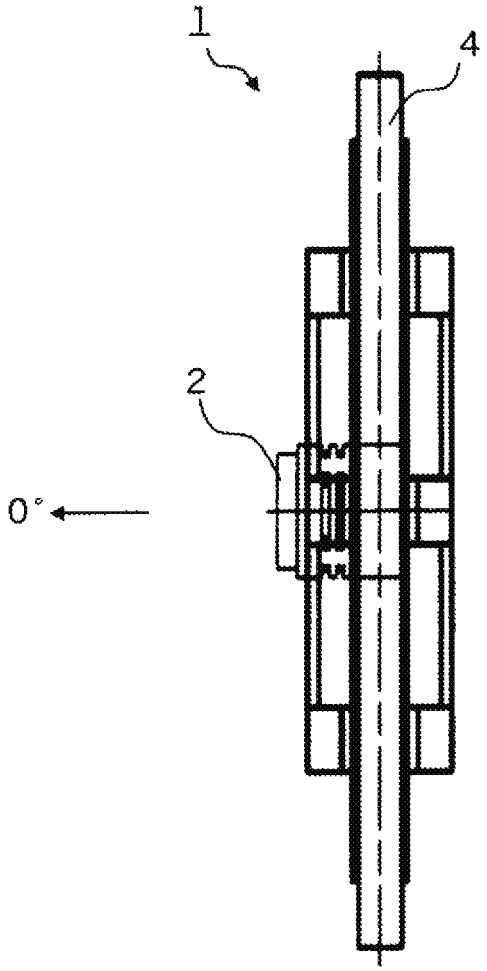
FIG. 3 is a side view of the unidirectional microphone of FIG. 1.

Hereinafter, an embodiment of the present invention will be described with reference to the drawings. FIG. 1 is a front view (a view as viewed from a 180° side of a sound collecting axis) of a unidirectional microphone according to the present invention, FIG. 2 is a plan view, and FIG. 3 is a side view. Further, FIGS. 4A and 4B are circuit diagrams of this unidirectional microphone 1.

Figure 4A:
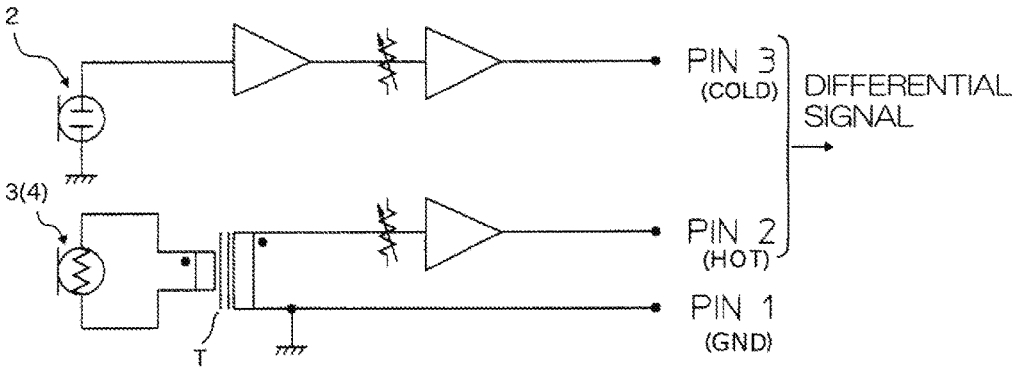
FIG. 4A is a circuit diagram of the unidirectional microphone of FIG. 1.
Figure 4B:
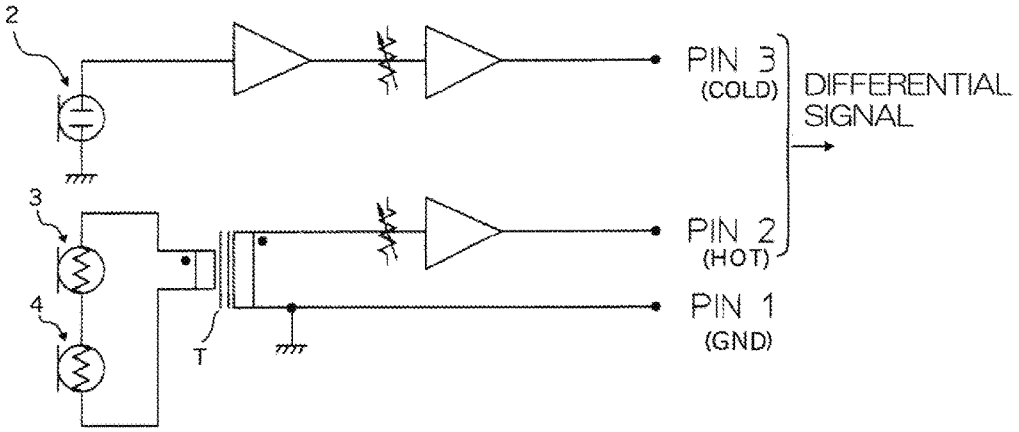
FIG. 4B is a circuit diagram of the unidirectional microphone of FIG. 1 for another example.

As illustrated in the drawings, the unidirectional microphone 1 includes one unidirectional condenser microphone 2, and two bi-directional ribbon microphones 3 and 4 which are symmetrically disposed to hold the unidirectional condenser microphone 2 therebetween (only one of the ribbon microphones is illustrated in FIG. 4A). The two bi-directional ribbon microphones 3 and 4 are electrically connected in series. FIG. 4B further shows a circuit diagram that includes two bidirectional ribbon microphones 3 and 4 connected in series.

To be specific, the bi-directional ribbon microphones 3 and 4 and the unidirectional condenser microphone 2 are arranged such that a 0° direction of a sound collecting axis of the unidirectional condenser microphone 2 accords with a 180° direction of sound collecting axes of the bi-directional ribbon microphones 3 and 4, and an output of the unidirectional condenser microphone 2 is subtracted from outputs of the bi-directional ribbon microphones 3 and 4.

Figure 5A:
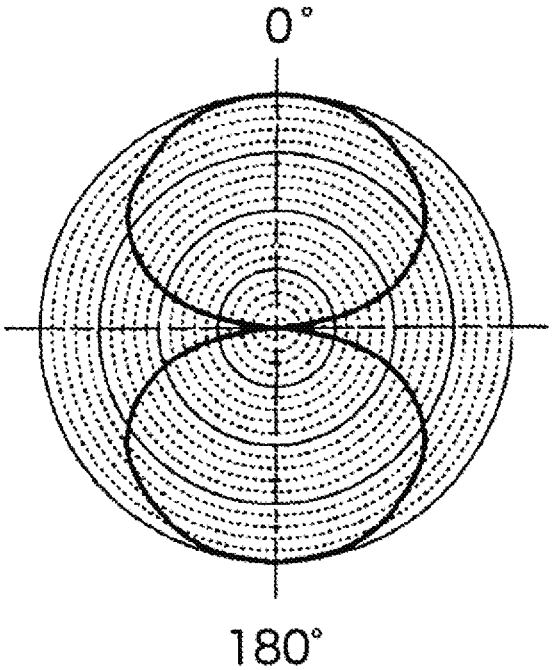
FIGS. 5A to 5C are graphs of directional frequency characteristics of microphone elements that constitute the unidirectional microphone of FIG. 1.
Figure 5B:
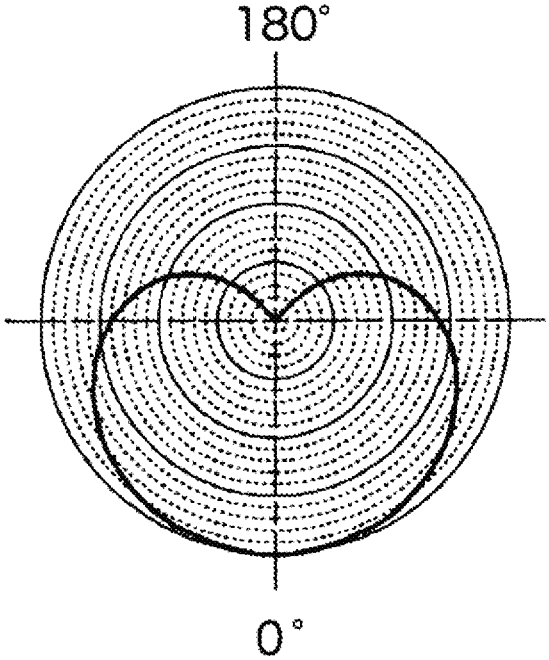
Figure 5C:
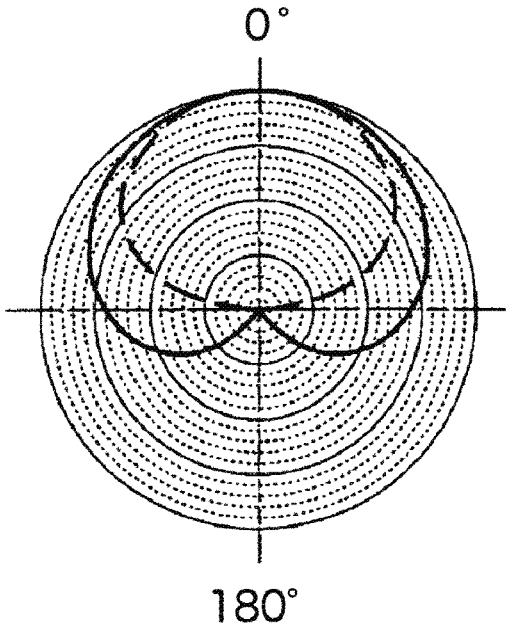
Figure 6A:
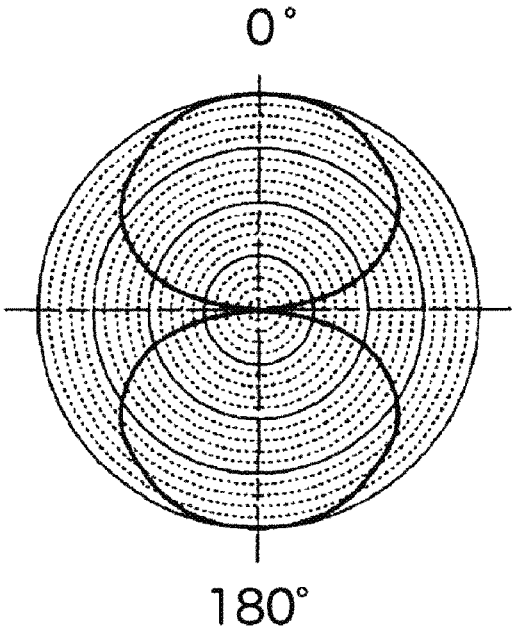
Fig. 6A Prior Art
FIGS. 6A to 6C are graphs of directional frequency characteristics of a bi-directional ribbon microphone element and a non-directional condenser microphone element that constitute a conventional unidirectional microphone.
Figure 6B:
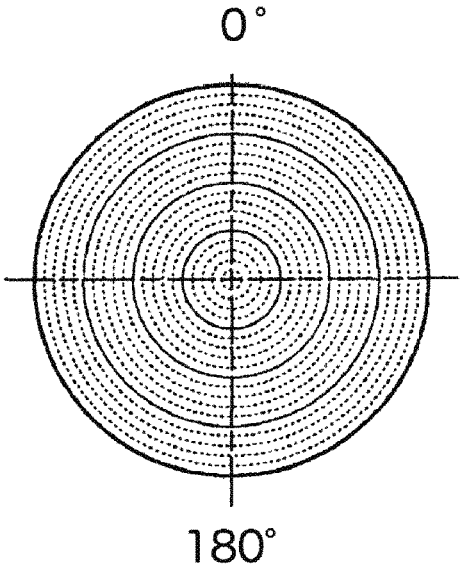
Fig. 6B Prior Art
Figure 6C:
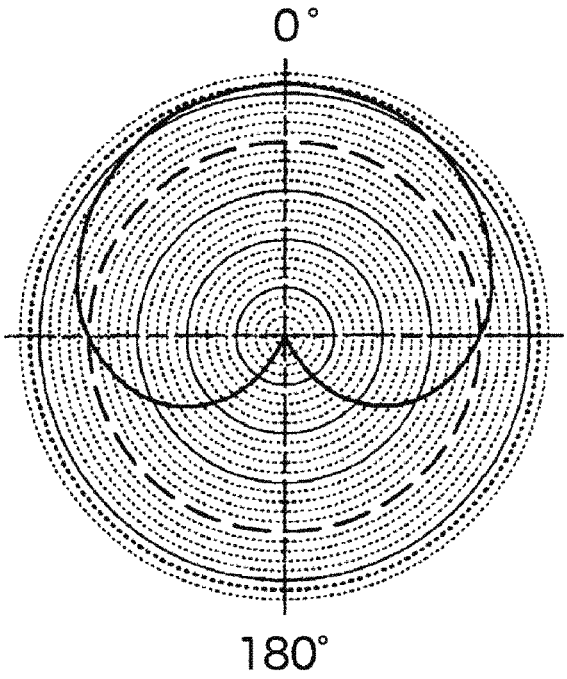
Fig. 6C Prior Art

FIGS. 5A, 5B, and 5C illustrate graphs of directional frequency characteristics of the respective microphones. FIG. 5A illustrates the directional frequency characteristics of the bi-directional ribbon microphones 3 and 4, FIG. 5B illustrates the directional frequency characteristics of the unidirectional condenser microphone 2, and FIG. 5C illustrates the directional frequency characteristics of the unidirectional microphone 1, where the output of the unidirectional microphone 1 is a differential output of the circuits shown in FIGS. 4A and 4B.

As illustrated in FIG. 5B, the unidirectional condenser microphone 2 has no response in a direction corresponding to the 0° direction illustrated in FIG. 5A of the sound collecting axes of the bi-directional ribbon microphones 3 and 4. That is, the unidirectional condenser microphone 2 has no response in a direction corresponding to 180° of the sound collecting axis. Therefore, as illustrated in FIG. 5C, the outputs in the 180° direction of the sound collecting axes of the bi-directional ribbon microphones 3 and 4 decreases in an output of the unidirectional microphone 1, and as a result unidirectivity is achieved.

That is, only the bi-directional ribbon microphones 3 and 4 have sensitivity for a sound wave from the 0° direction of the sound collecting axes of the bi-directional ribbon microphones 3 and 4.

In terms of the circuit diagram of FIG. 4, an output (PIN 3) of the unidirectional condenser microphone 2 and outputs (PINs 2) of the bi-directional ribbon microphones 3 and 4 are balanced output, and are differentially inputted to a mixer (not shown), and a subtraction output can be obtained from the mixer. The output voltages of the bi-directional ribbon microphones 3 and 4 are boosted up by a transformer T, and are outputted to the PINs 2. Note that a PIN 1 is a ground potential (GND), and one terminal of the unidirectional condenser microphone 2 and one terminal of the transformer T are connected to the ground potential.

According to the present embodiment, since the output of the unidirectional condenser microphone 2 is subtracted from the outputs in the 180° direction of the sound collecting axes of the bi-directional ribbon microphones 3 and 4, this configuration allows to achieve the unidirectivity without impairing the sound quality of the ribbon microphones. Further, use of the unidirectional microphone for amplification can prevent howling.

Note that, in the above-described embodiment, the two bi-directional ribbon microphones 3 and 4 are disposed laterally symmetric to the one condenser microphone 2. However, the present invention is not limited to the configuration, and a configuration using one bi-directional ribbon microphone may be employed.

Further, the unidirectional microphone 1 according to the present invention is not limited in its use forms and can be favorably used for portable microphones, stand microphones, and the like.

What is claimed is:

1. A unidirectional microphone comprising:

a unidirectional condenser microphone; and a bi-directional ribbon microphone, wherein the unidirectional condenser microphone and the bi-directional ribbon microphone are arranged such that a 0° direction of a sound collecting axis of the unidirectional condenser microphone accords with a 180° direction of a sound collecting axis of the bi-directional ribbon microphone, and an output of the unidirectional condenser microphone is subtracted from an output of the 180° direction of the bi-directional ribbon microphone, and only the bi-directional ribbon microphone has a sensitivity for a sound wave from the 0° direction of the sound collecting axis of the bi-directional ribbon microphone.

2. The unidirectional microphone according to claim 1, wherein the bi-directional ribbon microphone includes two bi-directional ribbon microphones disposed laterally symmetric to the unidirectional condenser microphone.

3. The unidirectional microphone according to claim 2, wherein the output of the unidirectional condenser microphone and outputs of the bi-directional ribbon microphones are outputted as a balanced output.

4. The unidirectional microphone according to claim 1, wherein the bi-directional ribbon microphone includes two bi-directional ribbon microphones arranged in parallel to each other, and the condenser microphone is arranged between the two bi-directional ribbon microphones.

* * * * *